US006017261A

United States Patent [19]

Wachtel

[11] Patent Number: 6,017,261

[45] Date of Patent: Jan. 25, 2000

[54] ANIMATED MECHANIZED FIGURE

[75] Inventor: Marc Wachtel, Melville, N.Y.

[73] Assignee: Telco Creations, Inc., Hicksville, N.Y.

[21] Appl. No.: 09/137,951

[22] Filed: Aug. 21, 1998

[51] Int. Cl.[7] ..... A63H 3/28; A63H 13/00

[52] U.S. Cl. ..... 446/301; 446/300; 446/338; 446/353; 40/415

[58] Field of Search ..... 446/298, 300, 446/301, 314, 330, 338, 353, 354, 489; 40/414, 415

[56] References Cited

U.S. PATENT DOCUMENTS

| | | | |
|---|---|---|---|
| 934,025 | 9/1909 | Steiff . | |
| 1,410,429 | 3/1922 | Vaughn . | |
| 1,503,735 | 8/1924 | Williams . | |
| 1,886,442 | 11/1932 | Wimmer | 446/338 |
| 2,105,904 | 1/1938 | Dale . | |
| 2,137,371 | 11/1938 | Marsh | 446/330 |
| 2,641,867 | 6/1953 | McEntyre . | |
| 3,153,871 | 10/1964 | Semba . | |
| 3,568,361 | 3/1971 | Bart . | |
| 4,389,811 | 6/1983 | Iwaya . | |
| 4,801,285 | 1/1989 | Yew . | |
| 4,828,530 | 5/1989 | Lee . | |
| 4,867,730 | 9/1989 | Lee . | |
| 4,869,703 | 9/1989 | Ong . | |
| 4,901,459 | 2/1990 | Lee . | |
| 4,913,676 | 4/1990 | Koguchi . | |
| 5,259,806 | 11/1993 | Chang . | |
| 5,273,479 | 12/1993 | Chang . | |
| 5,316,516 | 5/1994 | Saitoh . | |
| 5,523,523 | 6/1996 | Chen | 446/298 |
| 5,735,726 | 4/1998 | Cohen . | |

FOREIGN PATENT DOCUMENTS

| | | | |
|---|---|---|---|
| 984711 | 7/1951 | France | 446/353 |

*Primary Examiner*—Sam Rimell
*Assistant Examiner*—Jeffrey D. Carlson
*Attorney, Agent, or Firm*—Martin Smolowitz

[57] ABSTRACT

An animated mechanized figure which can be dressed as a tiger Santa character and is electrically-operated to provide vertical movements of the body and arms, forward and backward tilting of the head and vertical movements from the lower lip, together with vocal sounds emitted from a speaker provided in the body. The body member is movably supported from a central vertical post mounted on a base. A gear box is fixedly attached on the vertical post central portion within the body member, and contains a first electric drive motor and a driven rotor having an eccentric pin which contacts the body member rear part and moves the body and arms upward and downward, and also tilts the head forward and backward. The head member contains a second electric drive motor and driven rotor which is associated with a torsion spring unit and connected to a linkage which pivots the lower lip flap upward and downward in synchronism with vocal sounds emitted from the speaker mounted in the front part of the body member.

9 Claims, 6 Drawing Sheets

ANIMATED MECHANIZED FIGURE

BACKGROUND OF INVENTION

This invention pertains to an animated mechanical figure that is electrically-operated and provides body movements in synchronism with generated vocal sounds. It pertains particularly to such a figure for which the body member is vertically movable on a central vertical support, while both arms are vertically movable and the head is tiltable forward and back relative to the body.

Many mechanized figures have realistic shapes resembling various animals which have been developed and sold over many years. These figures have usually utilized various motor-driven gear trains and linkages to effect realistic movements of the arms and head of the figure; while the body portion of such animated figures has usually remained stationary. However, a mechanized animated figure providing for vertical body movements is disclosed by U.S. Pat. No. 3,568,361 to Bart et al in which a figure doll sitting in a chair periodically rises upwardly or shakes its head by means of an internal motor-driven gear train. Also, U.S. Pat. No. 5,735,726 to Cohen discloses a mechanized Santa figure which periodically rises from a sitting to a standing position and tilts its head by action of electric motor-driven gears and linkages provided within the body member, and produces speaking sounds synchronized with the body movements. However, the known prior art apparently has not provided an animated mechanized figure having its body vertically moveable on a central vertical support while its arms and head are movable in synchronism with vocal speaking and singing sounds.

SUMMARY OF INVENTION

This invention provides an animated mechanized figure, which is electrically-operated and provides realistic vertical body movements and vocal speaking sounds in synchronism with the body movements. The mechanized figure, which may have the form of a stuffed tiger Santa character, includes a body member which is movably supported on a vertical post fixedly mounted onto a base member, two vertically movable arms, and a head member pivotably attached onto the upper end of the body member. A gear box is fixedly attached onto the vertical post at an intermediate position within the body member, and contains a first electric drive motor and two belted pulleys and gears. From the gear box upper portion, a rotatable drive shaft and rotor are extended rearwardly, with the rotor having an eccentric pin which engages with the body member rear portion and with both its arms, so as to move the body member and both arms upwardly and downwardly. The body member vertical motions also causes the head member to be tilted forward and backward.

The head member contains a second electric drive motor which is connected through gears to a rotatable disc and a linkage element which can pivot the lower lip flap upwardly and downwardly in synchronism with vocal speaking and singing sounds emitted from a speaker unit fixedly mounted in the front portion of the body member. The base member contains dry cell batteries which are electrically connected through an on-off switch to a circuit board having microprocessors for generating the vocal speaking and singing sounds for the figure.

This invention advantageously provides an animated mechanical figure in which a body member encloses a gear box containing electric motor driven elements, the body member being vertically movable on a central support post while its two arms are vertically movable, its head member is tiltable forward and backward, and its lower lip is movable in synchronism with speaking and singing sounds emitted from a speaker.

BRIEF DESCRIPTION OF DRAWINGS

This invention will be described further with reference to the following drawings, in which.

DESCRIPTION OF INVENTION

Figure 1:
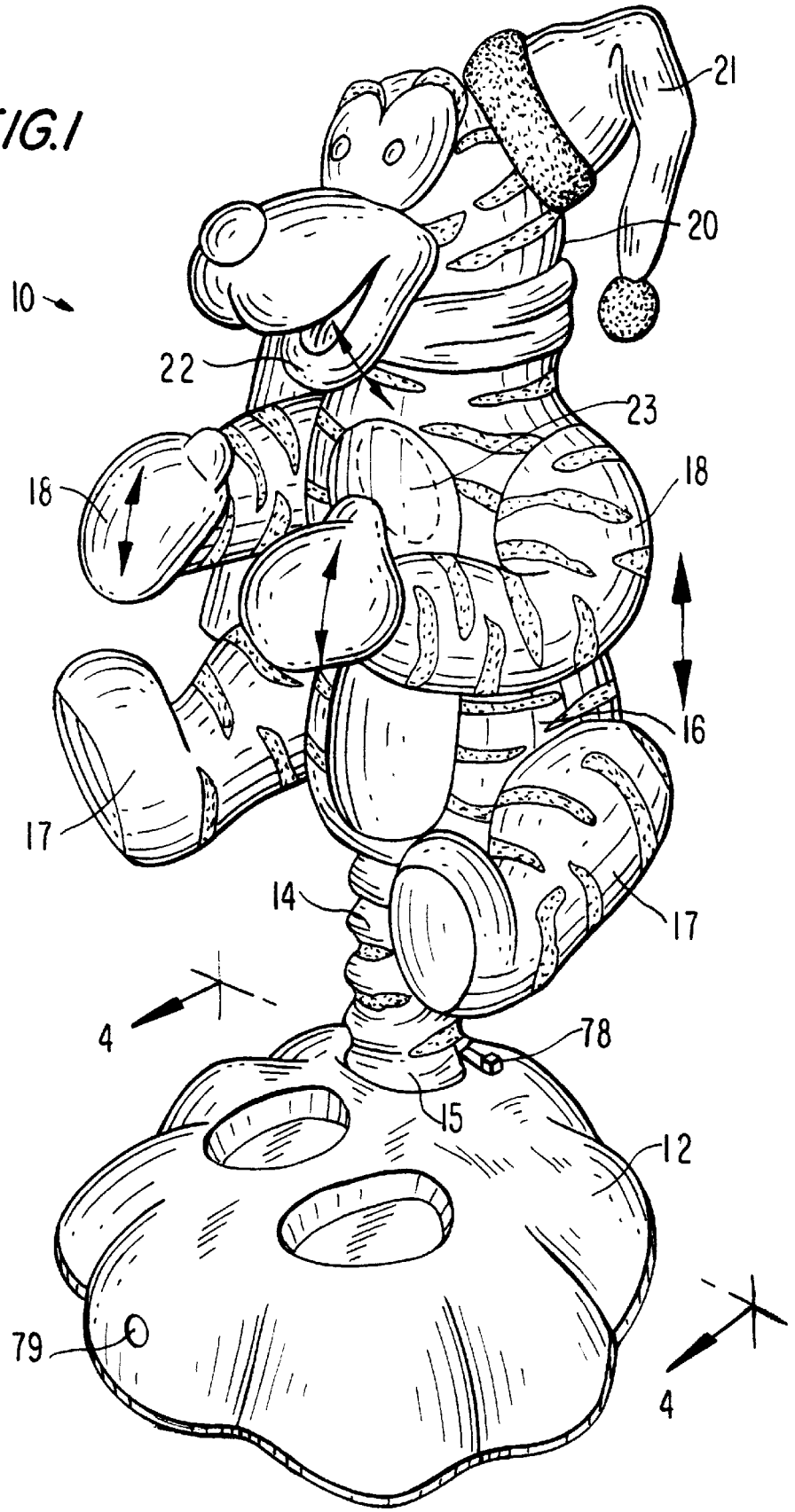
FIG. 1 is a perspective view of the animated mechanized figure having the form of a stuffed tiger Santa character.

As shown by FIG. 1, an animated mechanized FIG. 10 having the form of a stuffed tiger Santa character includes a base support member 12 and a central vertical post 14 attached rigidly onto the base member at structural joint 15. The FIG. 10 includes a body member 16, two legs 17, and two arms 18 which are each pivotably attached to the body member 16 so as to be movable upwardly and downwardly. A head member 20 having cap 21 is pivotably attached to the body member 16 upper end, so that the head is movable forward and backward in a nodding manner. A lower lip flap element 22 is pivotably attached to the head member 20 so as to be capable of vertical movement in synchronism with speaking sounds which are emitted from a speaker unit 23 located in the body member front side. The figure is dressed in a suitable fabric costume of a Santa character, the costume covering foam rubber elements (not shown) which are adhesively attached to the inner rigid structures of the figure body and head members. The central vertical post 14 is covered by a fabric material, 14*a* which is arranged to accommodate the vertical movements of the figure body member 16 relative to the base member 12.

Various inner structural elements and mechanical elements of the animated mechanized figure are shown by FIGS. 2, 3, 5 and 6. The vertical support post 14 is rigidly attached at its lower end to the horizontal base member 12 by an interfitting joint 15. A gearbox casing 24 is rigidly attached to the support post 14 at an intermediate location, and has a removable front cover plate 24*a*. The casing 24 supports a first electric motor 26 having a drive shaft 27, and has a small pulley 28 extending outwardly from the gearbox casing front side. The small pulley 28 drives a larger diameter pulley 30 through a belt 29. The larger pulley 30 drives a internal spur gear 31 which drives a pinion gear 31*a* (not shown).

Figure 2:
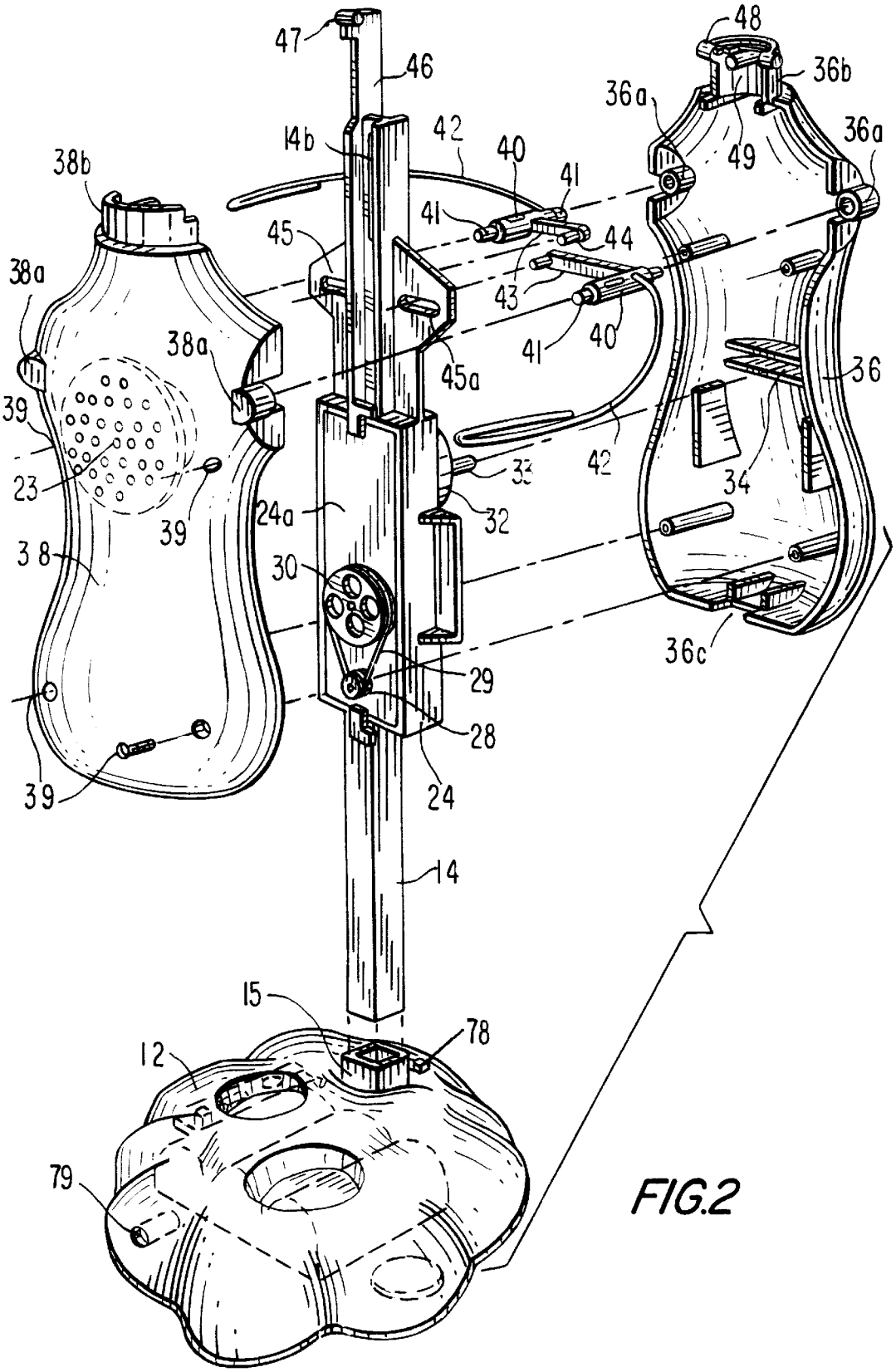
FIG. 2 is an exploded elevation view showing the various structural and mechanical elements of the figure base and body members constructed according to the invention.

Extending from the rear side of the gearbox 24 is a rotor 32 which is driven by the integral pinion gear 31*a*. The rotor 32 has an eccentric pin 33 which interfits within a horizontal slot 34 formed integrally within a rear shell part 36 of the body member 16. A front shell part 38 of the body member 16 is rigidly attached onto the rear shell part 36 at a vertical joint by suitable four screw fasteners 39 as shown by FIG. 2.

The two arms 18 of the animated mechanized FIG. 10 are each pivotably attached to both body shell parts 36 and 38 by a rotatable pin 40. Each pin has two opposite ends 41, which ends are each received into a sleeves 36*a* and 38*a* provided in the upper portion of each body shell part 36 and 38, respectively. A bent metal wire 42 is rigidly attached into each pin 40 and extends outwardly so as to provide a structure about which each of the stuffed arms 18 is formed.

Also extending radially inwardly from each rotatable pin 40 is a link 43 having an outer pin 44 extending forward. Each outer pin 44 engages with a horizontal slots 45*a* which is provided in a bracket 45 which is attached integrally to the upper portion of the support post 14. The support post 14 also includes an upper extension portion 46 having a horizontally extending pin 47. Also, an upward extension portion 36*b* of the rear body shell part 36 has dual horizontal pins 48 each extending outwardly from the extension portion 36*b*, which interfits with a mating upward extension portion 38*b* of the front body shell part 38. Also, a forward-extending pin 49 interfits with a vertical slot 14*b* provided in the upper portion of the support post 14 and together with notch 36*c* located at the lower end of rear body part 36 provides vertical guidance for the body member parts 36, 38 relative to the post 14.

By this construction, it will be apparent that operation of the first electric motor 26 rotates the rotor 32 so that the eccentric pin 33 being engaged in the horizontal slot 34 of rear body part 36, will cause the body member 16 to move upwardly and downwardly relative to the base 12 and support post 14. Such movement of body member 16 also produces corresponding vertical movement of the two arms 18 and tilts the head member 20 forward and back, as is explained further hereinbelow.

Figure 3:
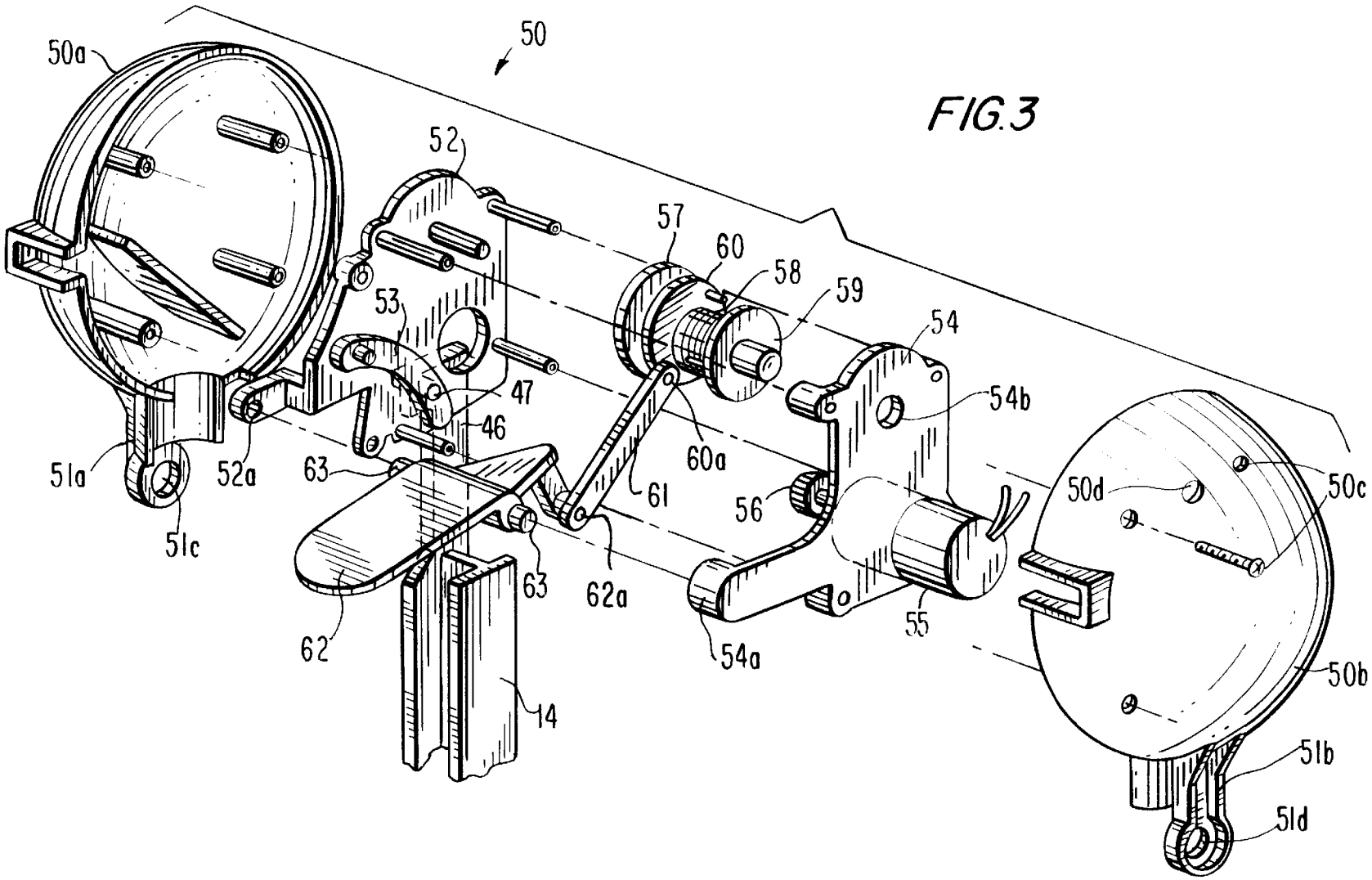
FIG. 3 is an exploded elevation view showing the figure head member and its inner mechanical elements for operating the mouth lip flap according to the invention.

The structural elements of the figure head member 20 and its attachment to the support post 14 and to body member 16 is shown in an exploded elevation view by FIG. 3. The head member 20 includes a head shell structure 50 formed of two mating hemispherical-shaped half shells 50*a* and 50*b*, which are attached together by multiple screw fasteners 50*c*. Each half shell 50*a* and 50*b* has a lower bracket 51*a* and 51*b* respectively, extending downwardly, and each bracket includes a hole 51*c* and 51*d* which each fits over one of the outwardly extending pins 48, and thereby serves to pivotably attach the head member 20 onto the body member rear part 36 at extension 36*b*.

Dual inner support brackets 52 and 54 are fixedly mounted within the head structure 50 by the multiple screw fasteners 50*c*. The brackets 52 includes a curved slot 53 into which is inserted the horizontal pin 47 of the post upper extension 46 to guide the nodding motion of the head member 20. A second electric motor 55 which is mounted in bracket 54 drives a small gear 56 which meshes with a larger diameter gear 57, which is combined with a torsion spring device 58 to drive a rotor 60 in an oscillating rotational manner. The rotor 60 has an eccentric pin 60*a* which is attached to a linkage 61, the linkage being attached to flapper lip 62 at pin 62*a* and acts to move the flapper lip 62 upwardly and downwardly while supported at dual pivots. The dual pivots 63 are each supported by being inserted into openings 52*a* and 54*a* in the brackets 52 and 54, respectively. Such intermittent movement of the lip flapper 62 is synchronized with vocal speaking and signing sounds emitted from speaker 23 which is fixedly mounted in the front half shell part 38 of the body member 16. Such intermittent oscillating motion of the rotor 60 and lip flap 62 is accomplished by the second motor 55 being operated intermittently to rotate the rotor 60 in one direction against the resistance of torsional spring 58, then after power to the motor 55 is interrupted by a controller and the spring 58 moves the rotor 60 in the opposite direction, thereby providing an oscillating motion to the linkage 61 and lip flapper 62. Tension in the torsion spring 58 can be adjusted externally by rotation of disk 59 through an opening 50*d* provided in the head half shell 50*b* and opening 54*b* in the support bracket 54.

Figure 4:
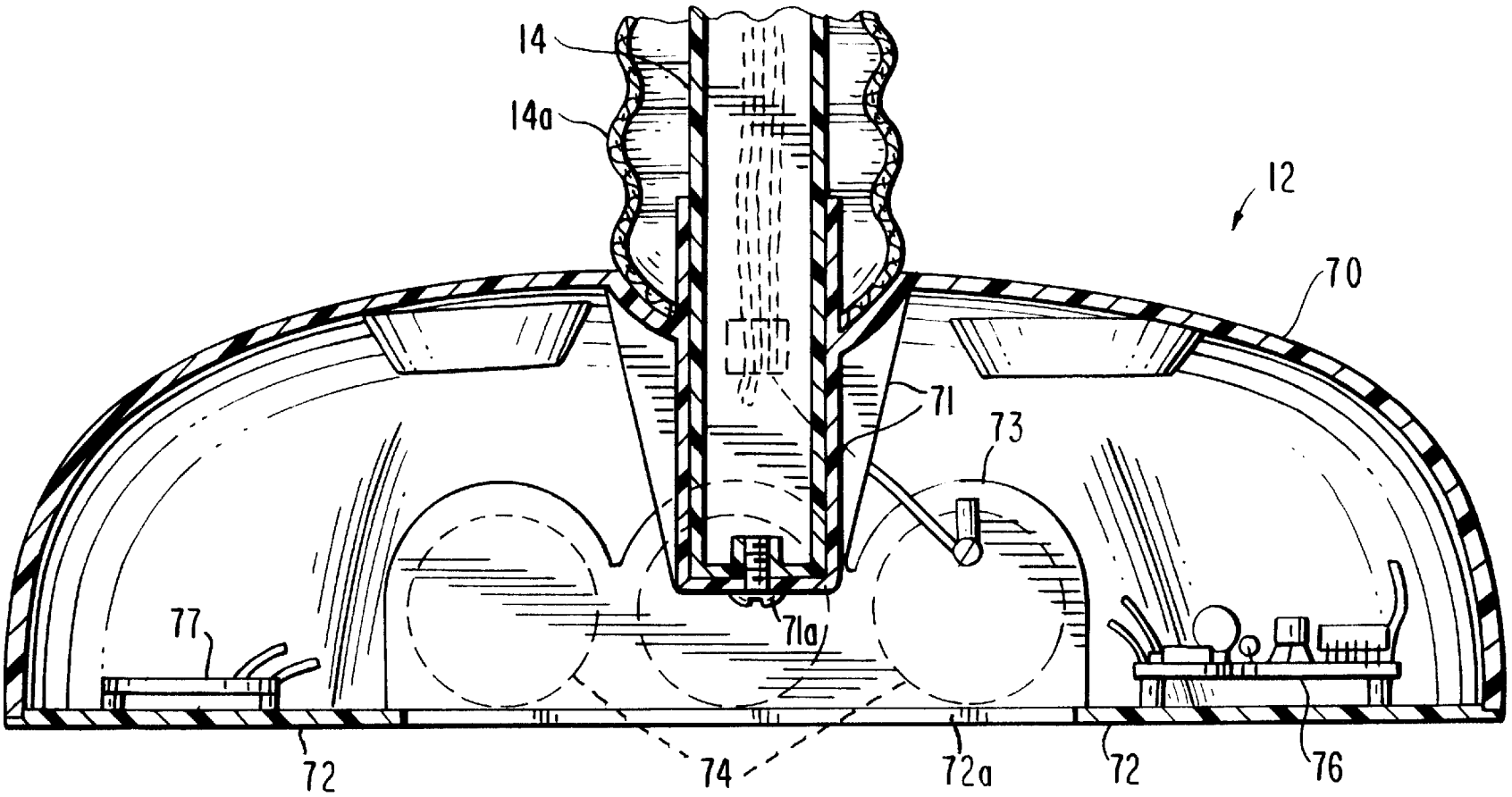
FIG. 4 shows an enlarged sectional view of the base and vertical support members taken along line 4—4 of FIG. 1, and including the battery enclosure and electrical elements.

As shown by FIG. 4, the base member 12 includes a housing 70 shaped for receiving the support post 14 in the structural joint 15 provided by a close fitting recess 71 in the housing rearward portion and retained therein by screw fastener 71*a*. The housing 70 has a lower closure plate 72 which includes an enclosure 73 shaped for receiving three 1.5 volt dry cell batteries 74 and is closed by lower inner plate 72*a*. The batteries 74 provide electric power to the two electric motors 26 and 55, and to a circuit board 76 and sound element 77 both mounted on the lower closure plate 72 of the base member 12 (se FIGS. 1 and 2). An on-off switch 78 and an electronic motion sensor 79 are provided mounted on the base member 12 to control operation of the figure by the dual electric motors 26 and 55 through the circuit board 76 and sound element 77.

The figure rigid structural elements are molded from a rigid plastic material such as high density polyethylene (HDPE) or polypropylene. The assembled structural members are covered first with a suitable resilient material such as foam rubber, and then by an outer fabric material which is colored and styled to resemble any desired animal or character, such as tiger Santa character.

Figure 5:
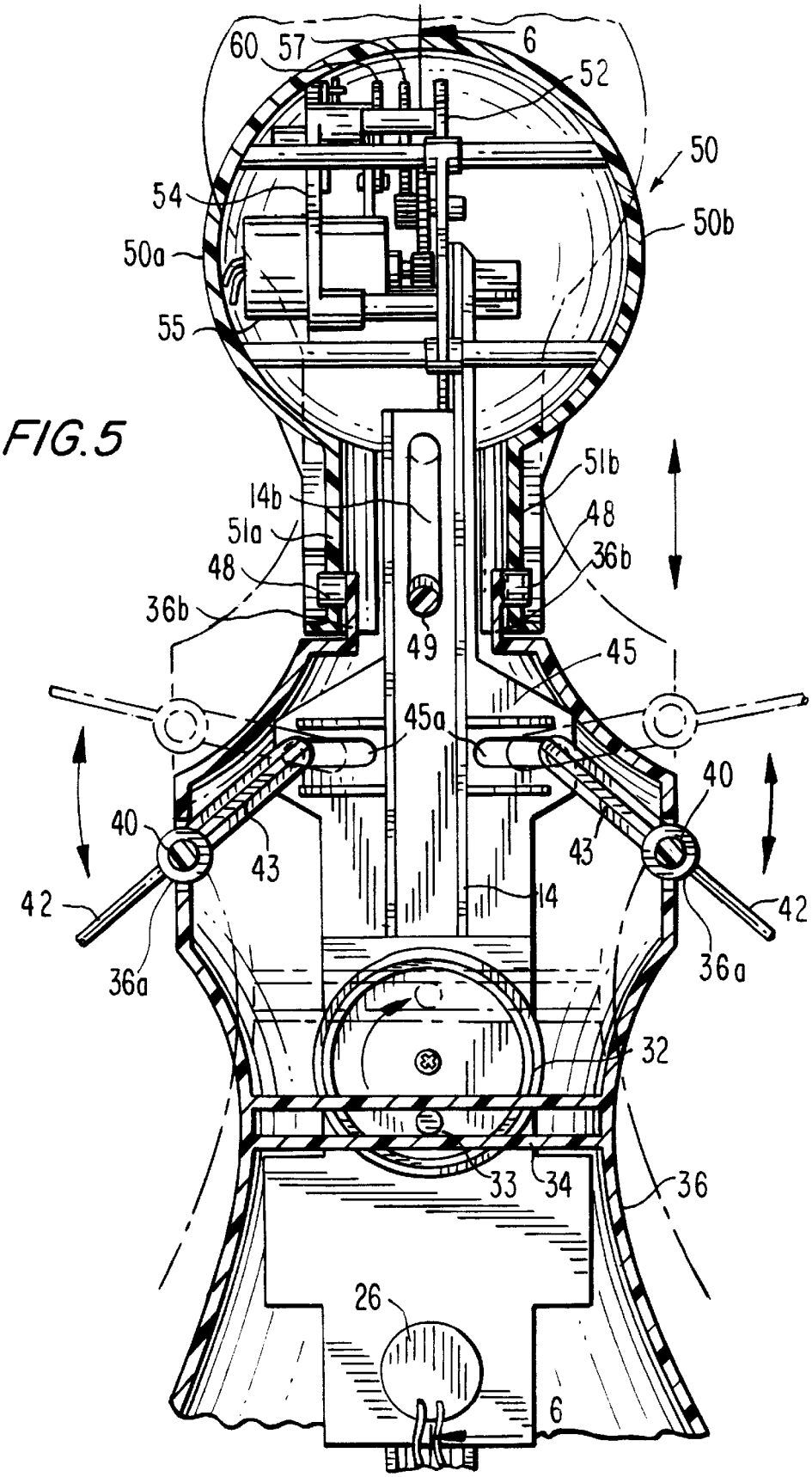
FIG. 5 is a rear sectional elevation view of the body member upper portion and head member.
Figure 6:
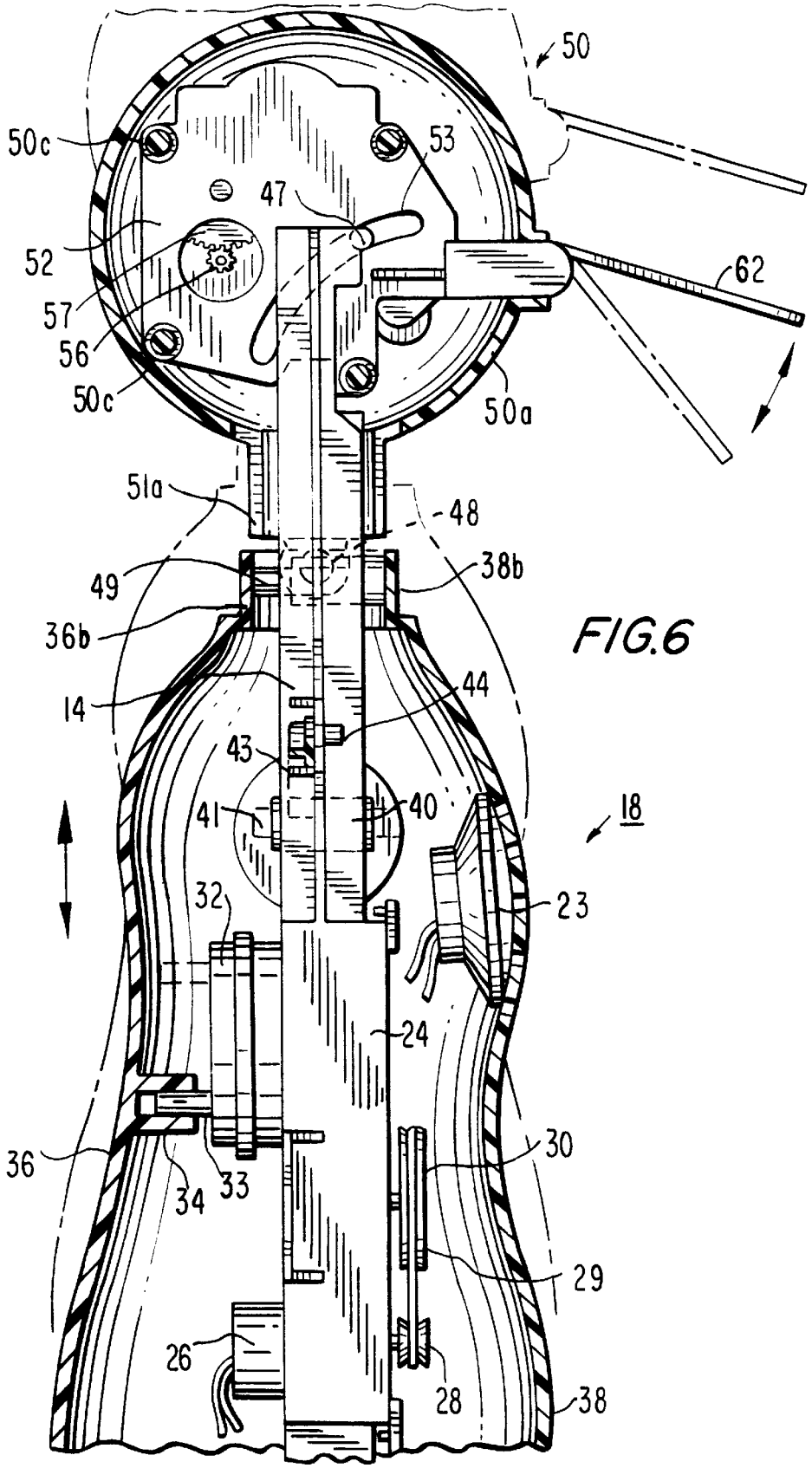
FIG. 6 is a side sectional elevation view of the body member upper portion and head member taken along line 6—6 of FIG. 5.

The assembled animated mechanized FIG. 10 of this invention is additionally depicted in elevational section views by FIG. 5 and 6 with the dotted lines indicating the extent of upward movement of the body and head member. As seen in the FIG. 5 rear view, the first electric motor 26 operates the rotor 32 which has its eccentric pin 33 engaged in the horizontal slot 34 of the body member rear part 36. The two rotatable pins 40 and the bent metal wires 42 of each of the two arms 18 are supported in sleeves 36*a*, and each inwardly extending link 43 has its pin 44 engaged in horizontal slots 45*a* of the bracket 45. Also, the rear body part upward extension 36*b* has its two horizontal pins 48 each engaged in a hole in downwardly extending brackets 51*a* and 51*b* of the head shell part 50*a* and 50*b* respectively, and the forward-extending pin 49 is engaged in vertical slot 14*b* of the vertical support post 14.

Within the head shell structure 50, the second electric motor 55 rotates gears 56 and 57 which are connected to rotor 60 and which operates linkage 61 and the pivoted lip flap element 62 (not shown). The mechanical parts within the head structure 50 are supported therein by the fixed internal brackets 52 and 54.

As shown by the right side view of FIG. 6, the first electric motor 26 drives pulleys 28 and 30, which through internal gears (not shown) drives rotor 32 and its eccentric pin 33. The pin 33 interfits in the horizontal slot 34 so that the rotation of rotor 32 moves the body member parts 36 and 38 upward and downward as indicated by the dotted lines. The half shell 50*a* of the head structure 50 retains the inner support bracket 52 by multiple elongated screw fasteners 50*c*. The head structure 50 is moved in a forward and back nodding motion about the horizontal pins 48 while being guided by pin 47 in slot 53. Also, the second electric motor 55 operates meshed gears 56, 57 and linkage 61 (not shown) so that the lip flapper 62 is pivotable upwardly and downwardly in synchronism with vocal sounds which are emitted from the speaker 23. Such singing and/or speaking sounds are emitted from speaker 23 as controlled by the microprocessors on the circuit board 76 and electrical sound element 77 in response to the on-off switch 78 and sensor 79 provided on the base member 12.

This invention will be further described by the following Example, which should not be construed as limiting the scope of the invention.

EXAMPLE

An animated mechanical figure was developed having the shape and image of a stuffed tiger Santa character. The figure is supported on a base and vertical post structure and includes a body member with two legs, two arms and a head member. The figure is electrically-operated by three 1.5 volt dry cell batteries and an on-off switch and electronic motion sensor in co-operation with a microprocessor unit located in the base support structure. The body member is vertically movable on the support post, and the two arms are vertically movable and the head nods forward and back by action of an electric motor and gear mechanism located within the body member, while the legs are not separately moveable. For the head member, the lower lip is pivoted in synchronism with vocal sounds emitted from a speaker located in the body member front part.

Some important dimensions and features of the stuffed tiger Santa figure are provided below:

| | |
|---|---|
| Figure overall height, in. | 16–18 |
| Vertical movement of body on support post, in. | 3–4 |
| Vertical movement of arms, in. | 2–3 |
| Vertical movement of lip, in | 0.5–1 |

For operation of the animated mechanical tiger Santa figure, after the on-off switch is manually turned on and the motion sensor both located in the base member senses that an observer is near, the first electric motor within the body member is operated on the post while the speaker emits speaking and/or singing sounds electrically produced by the microprocessor located in the base member. Also, the second electric motor and torsion return spring device located in the head member are operated by timing elements of the circuit board to pivot the lower lip upwardly and downwardly intermittently in synchronism with the vocal singing and/or speaking sounds.

Although this invention has been described broadly and also in terms of a specific embodiment, it is understood that modifications and variations can be made all within the scope as defined by the following claims.

I claim:

1. An animated mechanized figure, comprising:

(a) a rigid vertical extending support post which is attached at its lower end to a base member, said support post including a gear box casing and a first electric motor rotatably connected to a driven rotor;

(b) a body member movably supported on said post, said body member including a front and a rear shell part with the rear shell part including a horizontal slot engaged with said driven rotor; and (c) a head member pivotably attached both to an upper end of the support post and to the body member rear shell part upper end, said head member containing a second electric motor and having a pivotable flapper lip element which is adapted to be intermittently pivotably movable upward and downward by the second electric motor; whereby the first electric motor can operate the driven rotor so as to move the body member upward and downward and tilt the head member forward and backward, and the second electric motor can operate the pivotable flapper lip element to pivot it upward and downward.

2. The animated mechanical figure of claim 1, wherein said vertical support post has a lower end which is interfitted into a recess formed in an upper side of the base member and retained by screw means.

3. The animated mechanized figure of claim 1, wherein the front and rear shell parts of said body member are attached rigidly together along a vertical joint, and the rear shell part is vertically guided by said support post.

4. The animated mechanized figure of claim 1, wherein said body member includes dual arms which are each pivotably attached to the body member upper portion and are attached to slots provided in the vertical support post.

5. The animated mechanized figure of claim 1, wherein both said first and second electric motors are powered by at least one dry cell battery through on-off and sensor switches located in the base member.

6. The animated mechanized figure of claim 1, wherein a speaker unit is provided mounted in the body member front side, and a microprocessor unit is provided mounted in the base member, and both the speaker unit and the microprocessor unit are operable to produce vocal sounds which are synchronized with motions of the body members and its arms and the head member.

7. The animated mechanized figure of claim 1, wherein the pivotable flapper lip element is intermittently pivotably moveable by the second electric motor in combination with a rotor attached to a linkage element and a torsion spring device.

8. The animated mechanized figure of claim 1, wherein the body and head members are covered with an inner resilient padding material and an outer fabric material resembling a tiger Santa character.

9. An animated mechanized figure adapted for providing vertical body motions comprising:

(a) a rigid vertical extending support post which is attached at its lower end to a base member, said base member inlcuding a microprocessor unit, said support post including a gear box casing, and having a first electric motor rotatable connected to a driven rotor;

(b) a body member movably supported on said support post, said body member including front and rear shell parts, with the rear shell part including a horizontal slot engaged with an eccentric pin of said driven rotor, and having dual arms pivotably attached to the body member upper portion;

(c) a head member pivotably attached both to the support post upper end and to the body member rear shell part upper end; said head member containing a second electric motor and having a pivotable flapper lip element which is adapted to be intermittently pivotably movable upward and downward by the second electric motor; wherein both the first and second electric motors are powered by at least one dry cell battery through switches located in the base member; and whereby the first electric motor can operate the driven rotor so as to move the body member upward and downward and thereby tilt the head member forward and backward on the support post, and the second electric motor can operate to pivot the flapper lip element upward and downward as controlled by the microprocessor unit in the base member.

* * * * *